US007481080B2

(12) United States Patent
Hoppe

(10) Patent No.: US 7,481,080 B2
(45) Date of Patent: Jan. 27, 2009

(54) CLOTHES WASHER BRAKING METHOD AND APPARATUS

(75) Inventor: Christopher Gregory Hoppe, Louisville, KY (US)

(73) Assignee: General Electric Company, Schenectady, NY (US)

( * ) Notice: Subject to any disclaimer, the term of this patent is extended or adjusted under 35 U.S.C. 154(b) by 646 days.

(21) Appl. No.: 10/882,368

(22) Filed: Jul. 1, 2004

(65) Prior Publication Data

US 2006/0000031 A1 Jan. 5, 2006

(51) Int. Cl.
*D06F 33/00* (2006.01)

(52) U.S. Cl. ..... 68/12.16; 68/12.01; 68/12.19; 68/12.14; 68/12.15

(58) Field of Classification Search ..... 68/12.01, 68/12.16, 12.19, 12.14, 12.15
See application file for complete search history.

(56) References Cited

U.S. PATENT DOCUMENTS

| | | | | |
|---|---|---|---|---|
| 3,750,429 | A | 8/1973 | Gorsuch | |
| 3,888,269 | A | 6/1975 | Bashark | |
| 4,159,211 | A | 6/1979 | Hoffman et al. | |
| 4,225,812 | A | 9/1980 | Kraus | |
| 4,250,435 | A | 2/1981 | Alley et al. | |
| 4,538,433 | A * | 9/1985 | Durazzani | 68/140 |
| 5,394,582 | A * | 3/1995 | Moon | 8/158 |
| 5,838,127 | A | 11/1998 | Young et al. | |
| 6,029,298 | A | 2/2000 | Dausch et al. | |
| 6,257,027 | B1 * | 7/2001 | Imai | 68/12.12 |
| 7,028,511 | B2 * | 4/2006 | Cheyne | 68/12.16 |

FOREIGN PATENT DOCUMENTS

JP 406190188 * 7/1994

* cited by examiner

*Primary Examiner*—Michael Barr
*Assistant Examiner*—Jason Heckert
(74) *Attorney, Agent, or Firm*—George L. Rideout, Esq.; Armstrong Teasdale LLP

(57) ABSTRACT

In an exemplary embodiment, a washing machine includes a tub having a bottom wall with a cavity therein, a basket rotatably mounted within the tub and rotatable around a vertical axis, and a multi speed drive system coupled to the basket. The drive system is configured to rotate the basket at a plurality of speeds. The washing machine also includes a brake system coupled to the basket. The brake system is configured to brake the rotation of the basket. The washing machine further includes at least one resistive heater element mounted in the cavity of the tub; and an inverter coupled to the drive system, the brake system, and the at least one resistive heater element.

14 Claims, 4 Drawing Sheets

CLOTHES WASHER BRAKING METHOD AND APPARATUS

BACKGROUND OF THE INVENTION

This invention relates generally to washing machines, and, more particularly, to methods and apparatus for braking washer basket and heating wash liquid in washing machines.

Washing machines typically include a cabinet that houses an outer tub for containing wash and rinse water, a perforated clothes basket within the tub, and an agitator within the basket. A drive and motor assembly is mounted underneath the stationary outer tub to rotate the clothes basket and the agitator relative to one another, and a pump assembly pumps water from the tub to a drain to execute a wash cycle. See, for example, U.S. Pat. No. 6,029,298.

Traditionally, rinse portions of wash cycles include a deep-fill process wherein articles in the clothes basket are completely submerged in water and the water is agitated. As such, a large amount of water mixes with detergent remaining in the clothes after they are washed. While the concentration of detergent in the water is relatively small, a large amount of detergent can be removed from the clothes due to the large amount of water involved. It has become increasingly desirable, however, to reduce water consumption in washing operations.

At least some types of washing machines have reduced water consumption in rinsing operation by using re-circulating rinse water flow. In this type of system, rinse water is collected in a bottom of the tub and pumped back to spray nozzles located above the basket. The rinse water is re-circulated for a predetermined length of time before being discharged to drain. See, for example, U.S. Pat. No. 5,167,722. While such systems are effective to reduce water consumption, they increase costs of the machine by employing valves, pumps, conduits etc. that result in additional material and assembly costs.

BRIEF DESCRIPTION OF THE INVENTION

In one aspect, a washing machine is provided. The washing machine includes a tub having an outer wall with a cavity therein, a basket rotatably mounted within the tub and rotatable around a vertical axis, and a multi speed drive system coupled to the basket. The drive system is configured to rotate the basket at a plurality of speeds. The washing machine also includes a brake system coupled to the basket. The brake system is configured to brake the rotation of the basket. The washing machine further includes at least one resistive heater element mounted in the cavity of the tub; and an inverter coupled to the drive system, the brake system, and the at least one resistive heater element.

In another aspect, a method of operating a washing machine is provided. The washing machine includes a rotatable basket disposed in a wash tub, a resistive heater disposed in a cavity within an outer wall of the wash tub, a motor operatively coupled to the basket and an inverter operatively coupled to the motor and the resistive heater. The method includes loading clothes into the basket, adding a predetermined amount of wash liquid to the wash tub, heating the wash liquid at least partially with the resistive heater, washing the clothes for a predetermined time, draining the wash liquid from the wash tub, rotating the basket to remove residual wash liquid from the clothes in the basket, and braking the rotating basket by transferring energy from the motor through the inverter to the resistive heater.

In another aspect, a washing machine is provided that includes a tub with an outer wall having a cavity therein, a basket rotatably mounted within the tub and rotatable around a vertical axis, and a multi speed drive system coupled to the basket. The drive system is configured to rotate the basket at a plurality of speeds. The washing machine also includes a brake system coupled to the basket. The brake system configured to brake the rotation of the basket. The washing machine further includes at least one resistive heater element mounted in the cavity of the tub outer wall, an inverter coupled to the drive system, the brake system, and the at least one resistive heater element, and a controller operatively coupled to the drive system, the brake system, and the inverter. The controller is configured to operate the drive system and the brake system during a wash cycle to rotate the basket and brake the rotation of the basket.

DETAILED DESCRIPTION OF THE INVENTION

A vertical axis clothes washer that includes a resistive type booster heater located in a cavity of the wash tub is described below in detail. In special cycles with specific types of fabric that are sensitive to different temperature change, the washing machine will fill with cold water and then be heated by the resistive heater to the desired temperature in sequential small steps and continue to hold during the wash cycle. The resistive heater and a temperature sensor are located at the lowest point of the outer tub of the washing machine. Also, the resistive heater can be used in conjunction with an inverter as part of the braking resistor for energy dissipation during braking of the wash basket.

Figure 1:
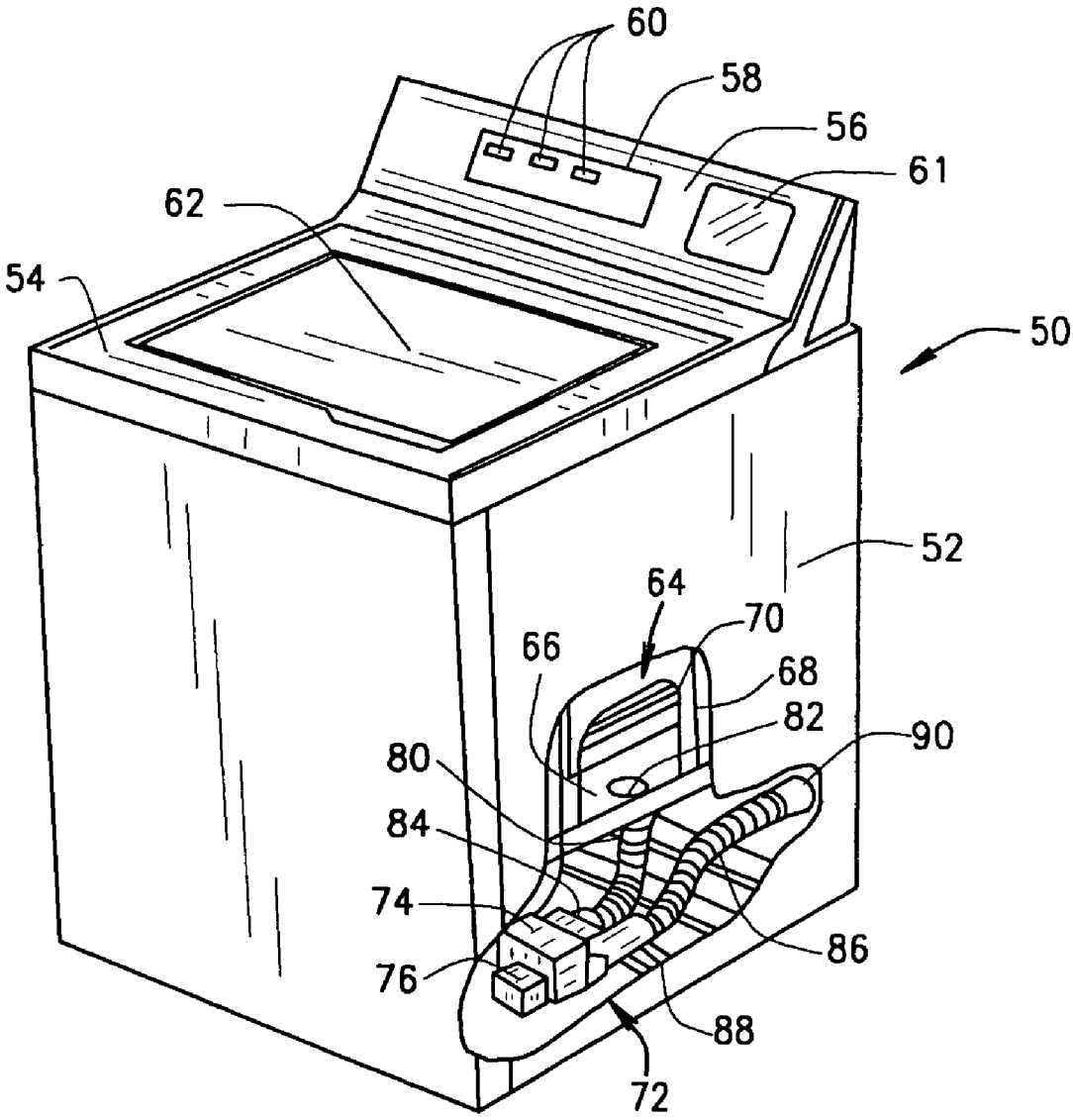
FIG. 1 is a perspective cutaway view of an exemplary washing machine.

Referring to the drawings, FIG. 1 is a perspective view partially broken away of an exemplary washing machine 50 including a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment a display 61 indicates selected features, a countdown timer, and other items of interest to machine users. A lid 62 is mounted to cover 54 and is rotatable about a hinge (not shown) between an open position (not shown) facilitating access to a wash tub 64 located within cabinet 52, and a closed position (shown in FIG. 1) forming a sealed enclosure over wash tub 64. As illustrated in FIG. 1, machine 50 is a vertical axis washing machine.

Tub 64 includes a bottom wall 66 and a sidewall 68, and a basket 70 is rotatably mounted within wash tub 64. A pump assembly 72 is located beneath tub 64 and basket 70 for gravity assisted flow when draining tub 64. Pump assembly 72 includes a pump 74 and a motor 76. A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with outlet 90.

Figure 2:
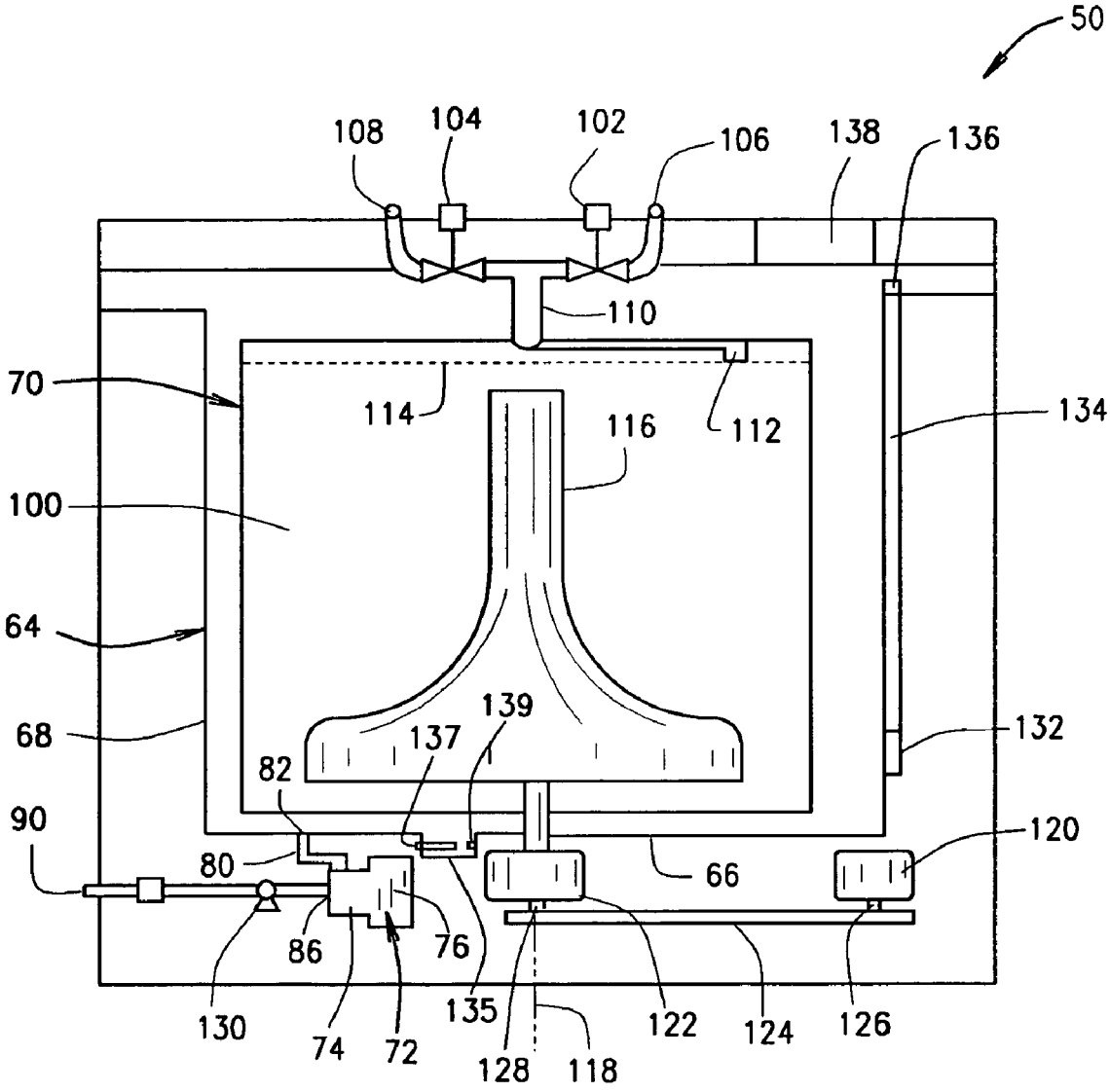
FIG. 2 is front elevational schematic view of the washing machine shown in FIG. 1.

FIG. 2 is a front elevational schematic view of washing machine 50 including wash basket 70 movably disposed and rotatably mounted in wash tub 64 in a spaced apart relationship from tub side wall 64 and tub bottom 66. Basket 12 includes a plurality of perforations therein to facilitate fluid communication between an interior of basket 70 and wash tub 64.

A hot liquid valve 102 and a cold liquid valve 104 deliver fluid, such as water, to basket 70 and wash tub 64 through a respective hot liquid hose 106 and a cold liquid hose 108. Liquid valves 102, 104 and liquid hoses 106, 108 together form a liquid supply connection for washing machine 50 and, when connected to a building plumbing system (not shown), provide a fresh water supply for use in washing machine 50. Liquid valves 102, 104 and liquid hoses 106, 108 are connected to a basket inlet tube 110, and fluid is dispersed from inlet tube 110 through a known nozzle assembly 112 having a number of openings therein to direct washing liquid into basket 70 at a given trajectory and velocity. A known dispenser (not shown in FIG. 2), may also be provided to produce a wash solution by mixing fresh water with a known detergent or other composition for cleansing of articles in basket 70.

In an alternative embodiment, a known spray fill conduit 114 (shown in phantom in FIG. 2) may be employed in lieu of nozzle assembly 112. Along the length of the spray fill conduit 114 are a plurality of openings arranged in a predetermined pattern to direct incoming streams of water in a downward tangential manner towards articles in basket 70. The openings in spray fill conduit 114 are located a predetermined distance apart from one another to produce an overlapping coverage of liquid streams into basket 70. Articles in basket 70 may therefore be uniformly wetted even when basket 70 is maintained in a stationary position.

A known agitation element 116, such as a vane agitator, impeller, auger, or oscillatory basket mechanism, or some combination thereof is disposed in basket 70 to impart an oscillatory motion to articles and liquid in basket 70. In different embodiments, agitation element 116 may be a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, agitation element 116 is oriented to rotate about a vertical axis 118.

Basket 70 and agitator 116 are driven by motor 120 through a transmission and clutch system 122. A transmission belt 124 is coupled to respective pulleys of a motor output shaft 126 and a transmission input shaft 128. Thus, as motor output shaft 126 is rotated, transmission input shaft 128 is also rotated. Clutch system 122 facilitates driving engagement of basket 70 and agitation element 116 for rotatable movement within wash tub 64, and clutch system 122 facilitates relative rotation of basket 70 and agitation element 116 for selected portions of wash cycles. Motor 120, transmission and clutch system 122 and belt 124 collectively are referred herein as a machine drive system.

Washing machine 50 also includes a brake assembly (not shown) selectively applied or released for respectively maintaining basket 70 in a stationary position within tub 64 or for allowing basket 70 to spin within tub 64. Pump assembly 72 is selectively activated, in the example embodiment, to remove liquid from basket 70 and tub 64 through drain outlet 90 and a drain valve 130 during appropriate points in washing cycles as machine 50 is used. In an exemplary embodiment, machine 50 also includes a reservoir 132, a tube 134 and a pressure sensor 136. As fluid levels rise in wash tub 64, air is trapped in reservoir 132 creating a pressure in tube 134 that pressure sensor 136 monitors. Liquid levels, and more specifically, changes in liquid levels in wash tub 64 may therefore be sensed, for example, to indicate laundry loads and to facilitate associated control decisions. In further and alternative embodiments, load size and cycle effectiveness may be determined or evaluated using other known indicia, such as motor spin, torque, load weight, motor current, and voltage or current phase shifts. A cavity 135 is located in bottom wall 66 of tub 64. Cavity 135 is located adjacent wash tub outlet 82 so that after liquid is drained from tub 64, cavity 135 still retains liquid. A resistive heater 137 and a temperature sensor 139 are positioned in cavity 135.

Operation of machine 50 is controlled by a controller 138 which is operatively coupled to the user interface input located on washing machine backsplash 56 (shown in FIG. 1) for user manipulation to select washing machine cycles and features. In response to user manipulation of the user interface input, controller 138 operates the various components of machine 50 to execute selected machine cycles and features.

In an illustrative embodiment, clothes are loaded into basket 70, and washing operation is initiated through operator manipulation of control input selectors 60 (shown in FIG. 1). Tub 64 is filled with water and mixed with detergent to form a wash fluid, and basket 70 is agitated with agitation element 116 for cleansing of clothes in basket 70. That is, agitation element is moved back and forth in an oscillatory back and forth motion. In the illustrated embodiment, agitation element 116 is rotated clockwise a specified amount about the vertical axis of the machine, and then rotated counterclockwise by a specified amount. The clockwise/counterclockwise reciprocating motion is sometimes referred to as a stroke, and the agitation phase of the wash cycle constitutes a number of strokes in sequence. Acceleration and deceleration of agitation element 116 during the strokes imparts mechanical energy to articles in basket 70 for cleansing action. The strokes may be obtained in different embodiments with a reversing motor, a reversible clutch, or other known reciprocating mechanism.

After the agitation phase of the wash cycle is completed, tub 64 is drained with pump assembly 72. Clothes are then rinsed and portions of the cycle repeated, including the agitation phase, depending on the particulars of the wash cycle selected by a user.

Figure 3:
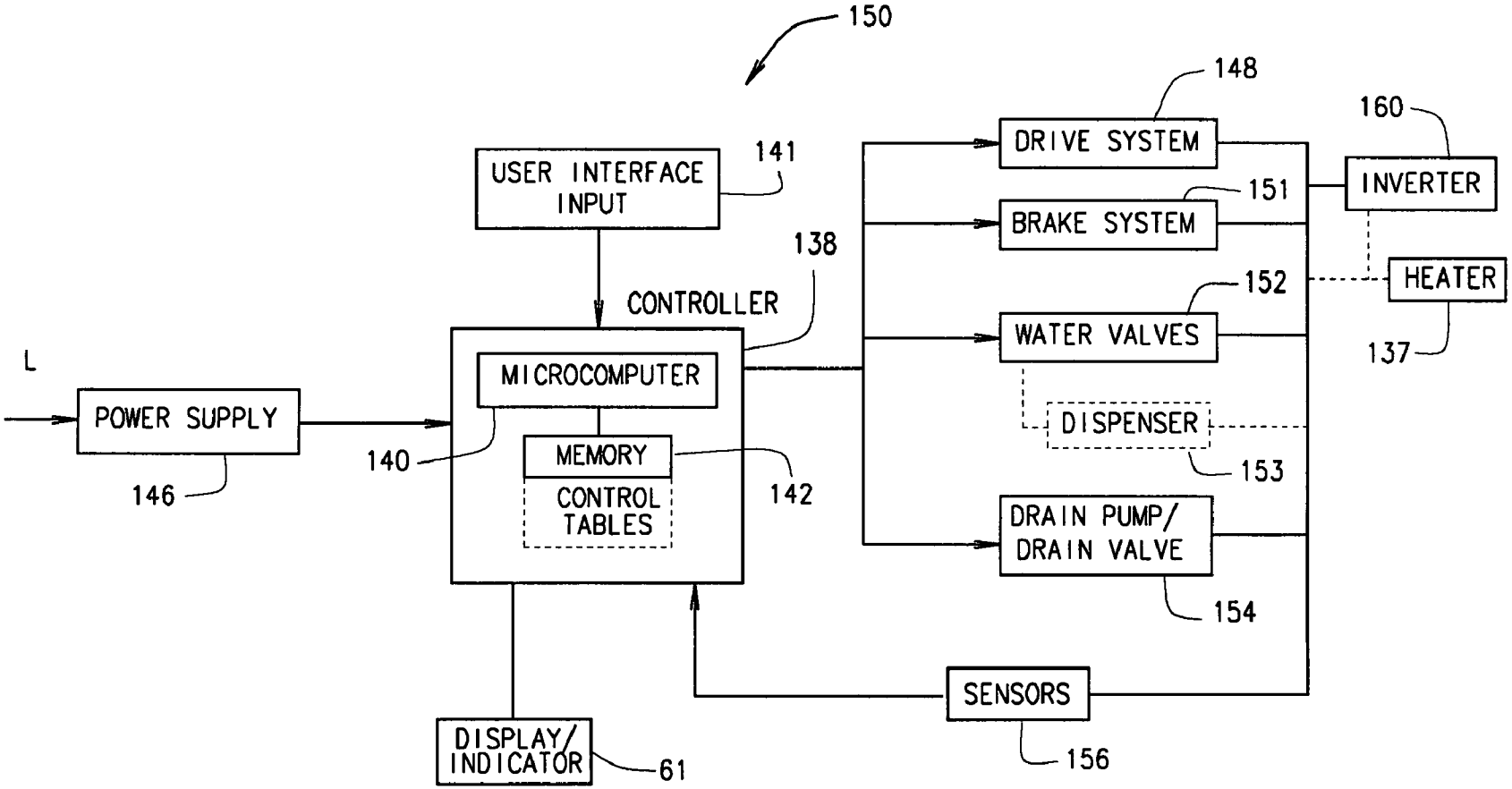
FIG. 3 is a schematic block diagram of a control system for the washing machine shown in FIGS. 1 and 2.

FIG. 3 is a schematic block diagram of an exemplary washing machine control system 150 for use with washing machine 50 (shown in FIGS. 1 and 2). Control system 150 includes controller 138 which may, for example, be a microcomputer 140 coupled to a user interface input 141. An operator may enter instructions or select desired washing machine cycles and features via user interface input 141, such as through input selectors 60 (shown in FIG. 1) and a display or indicator 61 coupled to microcomputer 140 displays appropriate messages and/or indicators, such as a timer, and other known items of interest to washing machine users. A memory 142 is also coupled to microcomputer 140 and stores instructions, calibration constants, and other information as required to satisfactorily complete a selected wash cycle. Memory 142 may, for example, be a random access memory (RAM). In alternative embodiments, other forms of memory could be used in conjunction with RAM memory, including but not limited to flash memory (FLASH), programmable read only memory (PROM), and electronically erasable programmable read only memory (EEPROM).

Power to control system 150 is supplied to controller 138 by a power supply 146 configured to be coupled to a power line L. Analog to digital and digital to analog converters (not shown) are coupled to controller 138 to implement controller inputs and executable instructions to generate controller output to washing machine components such as those described above in relation to FIGS. 1 and 2. More specifically, controller 138 is operatively coupled to machine drive system 148 (e.g., motor 120 and clutch system 122 shown in FIG. 2), a brake assembly 151 associated with basket 70 (shown in FIG. 2), machine water valves 152 (e.g., valves 102, 104 shown in FIG. 2) and machine drain system 154 (e.g., drain pump assembly 72 and/or drain valve 130 shown in FIG. 2) according to known methods. In a further embodiment, water valves 152 are in flow communication with a dispenser 153 (shown in phantom in FIG. 3) so that water may be mixed with detergent or other composition of benefit to washing of garments in wash basket 70.

In response to manipulation of user interface input 141 controller 138 monitors various operational factors of washing machine 50 with one or more sensors or transducers 156, and controller 138 executes operator selected functions and features according to known methods. Of course, controller 138 may be used to control washing machine system elements and to execute functions beyond those specifically described herein. Controller 138 operates the various components of washing machine 50 in a designated wash cycle familiar to those in the art of washing machines.

Additionally, controller 138 is coupled to an inverter 160 that is, in turn, coupled to drive system 148, brake system 151, and resistive heater 137. Inverter 160 is supplied continuously with AC power and used to control motor 120 (shown in FIG. 2) at a selected speed in response to a signal from controller 138, such as square wave of 0-5 V in one embodiment. As such, motor 120 is operable at a plurality of speeds. Also, inverter 160 is used as part of brake system 151 to brake the rotation of basket 70 by diverting excess energy to resistive heater 137 for dissipation into the liquid remaining in cavity 135.

Figure 4:
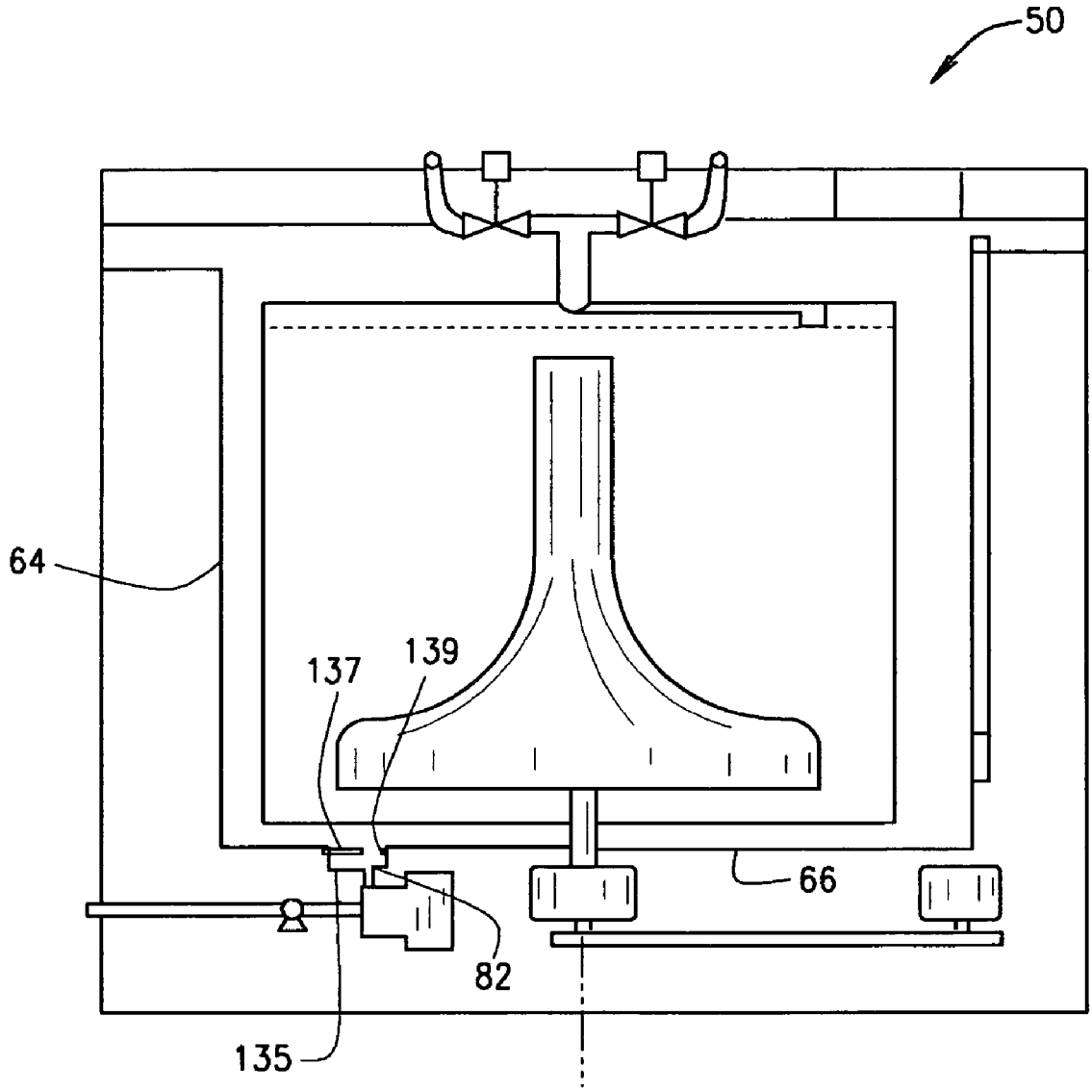
FIG. 4 is a schematic illustration of another embodiment of the washing machine shown in FIGS. 1 and 2.

FIG. 4 is a schematic illustration of another embodiment of washer 50. As shown in FIG. 4, wash tub outlet 82 is positioned inside cavity 135 so that as liquid is drained from tub 64, cavity 135 is also drained of liquid.

While the invention has been described in terms of various specific embodiments, those skilled in the art will recognize that the invention can be practiced with modification within the spirit and scope of the claims.

What is claimed is:

1. A washing machine comprising:

a tub comprising a bottom wall defining a cavity, said cavity configured to retain a portion of a wash liquid as the wash liquid is drained from said tub;

a basket rotatably mounted within said tub, said basket rotatable around a vertical axis;

a multi speed drive system coupled to said basket, said drive system configured to rotate said basket at a plurality of speeds;

a brake system coupled to said basket, said brake system configured to brake the rotation of said basket;

at least one resistive heater element mounted in said cavity; and an inverter coupled to said drive system, said brake system, and said at least one resistive heater element, said inverter configured to divert energy to said at least one resistive heater element, and said at least one resistive heater element configured to dissipate the diverted energy into the portion of the wash liquid within said cavity.

2. A washing machine in accordance with claim 1 wherein said tub comprises a drain outlet.

3. A washing machine in accordance with claim 2 wherein said drain outlet is located in said cavity of said tub bottom wall.

4. A washing machine in accordance with claim 2 wherein said drain outlet is located outside said cavity of said tub outer wall.

5. A washing machine in accordance with claim 1 further comprising an agitator mounted within said basket.

6. A washing machine in accordance with claim 5 wherein said drive system configured to oscillate said agitator at a plurality of speeds, and said brake system configured to brake the oscillation of said agitator.

7. A washing machine in accordance with claim 1 further comprising a controller operatively coupled to said drive system, said brake system, and said inverter, said controller configured to operate said drive system and said brake system during a wash cycle to:

oscillate said agitator;

brake the oscillation of said agitator;

rotate said basket;

and brake the rotation of said basket.

8. A washing machine comprising:

a tub comprising a bottom wall defining a cavity, said cavity configured to retain a portion of a wash liquid as the wash liquid is drained from said tub;

a basket rotatably mounted within said tub, said basket rotatable around a vertical axis;

a multi speed drive system coupled to said basket, said drive system configured to rotate said basket at a plurality of speeds;

a brake system coupled to said basket, said brake system configured to brake the rotation of said basket;

at least one resistive heater element mounted in said cavity;

an inverter coupled to said drive system, said brake system, and said at least one resistive heater element, said inverter configured to divert energy to said at least one resistive healer element, and said at least one resistive heater element configured to dissipate the diverted energy into the portion of the wash liquid within said cavity; and a controller operatively coupled to said drive system, said brake system, and said inverter, said controller configured to operate said drive system and said brake system during a wash cycle to:

rotate said basket;

and brake the rotation of said basket.

9. A washing machine in accordance with claim 8 wherein said drive system further comprises a motor operatively coupled to said basket, said controller further configured to brake the rotation of said basket by directing energy from said motor through said inverter to said resistive heater.

10. A washing machine in accordance with claim 9 further comprising an agitator mounted within said basket.

11. A washing machine in accordance with claim 10 wherein said drive system further configured to oscillate said agitator at a plurality of speeds, and said brake system configured to brake the oscillation of said agitator.

12. A washing machine in accordance with claim 11 wherein said controller is further configured to operate said drive system and said brake system during a wash cycle to:

oscillate said agitator;

and brake the oscillation of said agitator.

13. A washing machine in accordance with claim 1, further comprising a temperature sensor positioned within said cavity.

14. A washing machine in accordance with claim 8, further comprising a temperature sensor positioned within said cavity.

* * * * *